US005381483A

United States Patent [19]

Grau

[11] Patent Number: 5,381,483

[45] Date of Patent: Jan. 10, 1995

[54] MINIMAL INDUCTANCE ELECTRODYNAMIC TRANSDUCER

[75] Inventor: Noel J. Grau, Rio Piedras, P.R.

[73] Assignee: Commonwealth of Puerto Rico, San Juan, P.R.

[21] Appl. No.: 42,714

[22] Filed: Apr. 5, 1993

[51] Int. Cl.[6] ..... H04R 25/00

[52] U.S. Cl. ..... 381/192; 381/199; 381/201; 381/205

[58] Field of Search ..... 381/194, 192, 199, 205, 381/201

[56] References Cited

U.S. PATENT DOCUMENTS

| | | | |
|---|---|---|---|
| 1,992,300 | 2/1935 | Fanger . | |
| 2,727,949 | 12/1955 | Lokkesmoe . | |
| 3,830,986 | 8/1974 | Yamamuro . | |
| 3,867,587 | 2/1975 | Yamamuro . | |
| 3,881,074 | 4/1975 | Kawamura . | |
| 3,922,501 | 11/1975 | Yamamuro . | |
| 4,160,133 | 7/1979 | Wiik . | |
| 4,289,937 | 9/1981 | Ikeda et al. | 381/194 |
| 4,783,824 | 11/1988 | Kobayashi . | |
| 5,062,140 | 10/1991 | Inanaga et al. | 381/199 |

FOREIGN PATENT DOCUMENTS

| | | | |
|---|---|---|---|
| 864516 | 4/1941 | France . | |
| 0206297 | 12/1983 | Japan | 381/194 |
| WO91/05447 | 4/1991 | WIPO . | |

OTHER PUBLICATIONS

The Audio Cyclopedia, Section 20, pp. 1079–1080.
JA 58–120396, Jul. 18, 1983, Abstract.
JA 60–214198, Oct. 26, 1985, Abstract.
JA 57–28497, Feb. 16, 1982, Abstract.
JA 57–196697, Dec.2, 1982, Abstract.
JA 2–131100, May 18, 1990, Abstract.
JA 2–237393, Sep. 19, 1990, Abstract.

*Primary Examiner*—Curtis Kuntz
*Assistant Examiner*—Sinh Tran
*Attorney, Agent, or Firm*—Oblon, Spivak, McClelland, Maier & Neustadt

[57] ABSTRACT

A minimal inductance electrodynamic transducer having ferromagnetic shunting rings coated with a highly conductive material to increase the induced current carrying capacity of the transducer. A plurality of thin shunting rings separated by a non-conductive adhesive, attached to a pole piece connected to a magnet and/or a center pole, allows the device to operate at high power levels without saturation. The shunting rings also allow for sufficient induced current to flow in the magnetic circuit in order to oppose the magnetic field created by the voice coil.

17 Claims, 1 Drawing Sheet

MINIMAL INDUCTANCE ELECTRODYNAMIC TRANSDUCER

BACKGROUND OF THE INVENTION

1. Field of the Invention

This invention relates to a common electrodynamic transducer, also referred to as an electro-acoustic converter, such as a speaker or microphone. The invention further relates to an improved magnetic circuit used in the electrodynamic transducer.

2. Discussion of the Background

The most popular design of transducers used today in electrodynamic loudspeakers has a moving coil in a magnetic field as the moving mechanism. This mechanism has three primary parts: the voice coil, the permanent magnet, and the flux return structure which can be a center pole piece. The relation between the magnetizing force and magnetic flux density in the common electrodynamic transducer is non-linear. Therefore, when magnetic flux of a voice coil passes through a center pole, the magnetic reaction in the voice coil can result in a distorted output signal from the electrodynamic transducer.

SUMMARY OF THE INVENTION

Accordingly, it is an object of this invention to reduce the non-linearity and distortion produced in an electrodynamic transducer. It is a further object of this invention to inhibit the voice coil's perturbation of the constant flux density in the magnetic structure by inhibiting flux leakages circulating in the structure and around the voice coil.

These and other objects are accomplished by an electrodynamic transducer having one or more shunting rings. In the electrodynamic transducer, a pole piece is mounted onto a magnet. A return magnetic flux path is provided by a center pole piece connected through a yoke to the magnet. There is an air gap between the pole piece connected to the magnet and the center pole piece with a voice coil disposed therebetween. One or more shunting rings are attached to the magnet pole piece and/or the center pole piece in such a manner as to face the voice coil.

The shunting rings have a ferromagnetic core surrounded by a highly conductive material such as silver, gold, aluminum or copper. The shunting rings inhibit flux leakages in the magnetic circuit of the electrodynamic transducer and inhibit the voice coil's perturbation of the constant flux density in the magnetic structure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
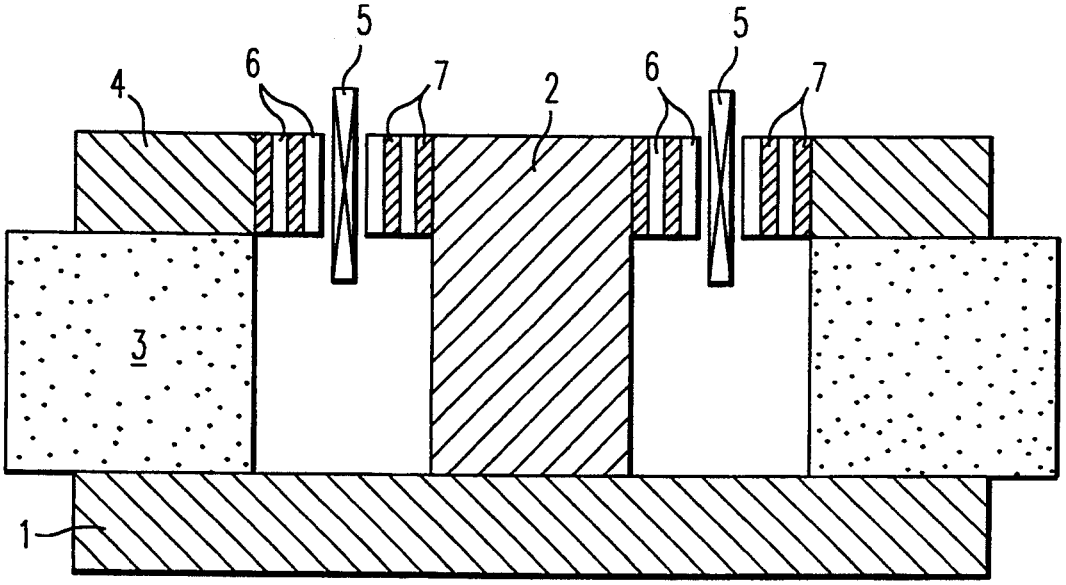
FIG. 1 illustrates a cross-sectional view of a minimal inductance electrodynamic transducer constructed in accordance with the present invention.

Referring now to the drawings, wherein like reference numerals designate identical or corresponding parts throughout the several views, and more particularly to FIG. 1 thereof, there is illustrated an embodiment of a minimal inductance electrodynamic transducer constructed in accordance with the invention. The electrodynamic transducer contains a magnet 3 mounted between yoke 1 and pole piece plate 4. There is a center pole piece shank 2 which serves as the flux return structure. A voice coil 5 is disposed between the pole piece plate 4 and center pole piece shank 2.

Mounted on pole piece plate 4 and/or center pole piece shank 2 are one or more shunting rings 6. The thickness of the shunting rings can be about 2 millimeters, although the invention can employ shunting rings having a thickness which is greater than or less than 2 mm. The shunting rings are attached to each other and the pole piece plate and/or center pole piece shank 2 by non-conductive adhesive 7. The non-conductive adhesive 7 can be a commercially available adhesive such as common epoxy. The thickness of the adhesive is preferably as small as possible although different thickness of adhesive can be used.

Figure 2:
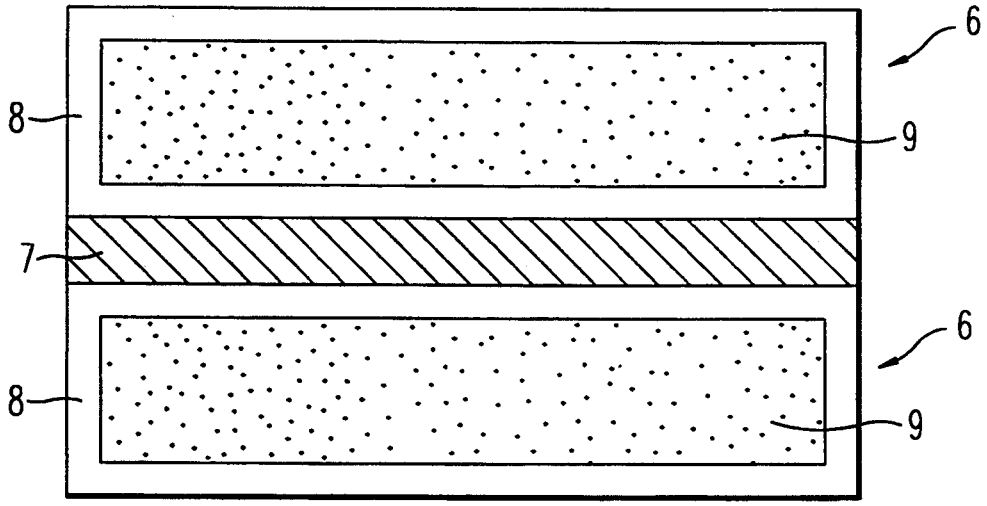
FIG. 2 illustrates a cross-section of the shunting rings of the electrodynamic transducer illustrated in FIG. 1.

FIG. 2 shows, in cross-sectional form, the constituent parts of the shunting rings 6. Each shunting ring 6 contains a ferromagnetic core 9 and an outer layer of a highly electroconductive material 8. The electroconductive material 8 can be silver, gold, aluminum, copper, or any material which is a better conductor than iron or steel. The highly conductive electroconductive material 8 increases the efficiency of the shunting rings. However, it is possible to construct the shunting rings without the electroconductive material 8 or with the electroconductive material 8 having a conductivity which is equal to or less than the ferromagnetic core 9, although the efficiency of the shunting rings will be reduced. Further, the material making up the core might be varied.

The present invention provides a practical way of correcting three major ailments of the common electrodynamic transducer: complex impedance, non-linear phase response, and self-induced distortion. The shunting rings inhibit the transformation between electric and magnetic energies in the transducer, thus greatly increasing the precision of the electrodynamic transducer.

The three above-mentioned problems of the electrodynamic transducer arise from the inductive reactance generated by the transducer's voice coil. The voice coil essentially acts as a choke. When a current flows through the coil, it produces a magnetic field which, depending on the polarity of the current, will align with or oppose the magnetic structure's constant field. With a time-varying current such as a periodic or sinusoidal current, the coil creates a field that for half of a cycle will align with the permanent magnet's field, while for the other half of the cycle, will oppose the permanent magnet's field. This creates an asymmetrical response in the transducer.

When a current I is passed through a voice coil, it will generate a magnetic field $B_I$ that is proportional to the current. Assuming a consistent system of units:

$$B_I = KI \qquad \text{(Eq. 1)}$$

where K is a constant depending upon the number of turns in the coil, the radius of the coil, and length of the coil, and the reluctance associated with the magnetic circuit.

As the magnetic structure of the transducer has its own constant magnetic field Bo, the flux density due to the permanent magnet, the induced magnetic field will add algebraically to the existing magnetic field of the permanent magnet, thus producing a resultant field $B_T$ in the air gap given by:

$$B_T = B_O + B_I = B_O + KI \quad \text{(Eq. 2)}$$

It is assumed that in Equation 2, the area through which the fluxes are passing is the same.

The force F acting on the voice coil is equal to the product of the magnetic flux density in the air gap $B_T$, multiplied by the voice coil's wire length L, multiplied by the current I:

$$F = B_T LI \quad \text{(Eq. 3)}$$

Substituting the value of $B_T$ of Equation 2 into Equation 3, yields a force equation of:

$$F = (B_O + KI)LI = B_O LI + KLI^2 \quad \text{(Eq. 4)}$$

The first term of Equation 4, $B_O LI$ (a linear term) is a force created by the magnetic structure. The second term $KLI^2$ (a non-linear term) is the force due to the voice coil's perturbation of the magnetic structure's constant field $B_O$. The second term is pure distortion.

In an ideal transducer, the force acting on the voice coil should be directly proportional to the current passing through the coil. However, in a conventional prior art transducer, the magnetic field created by the voice coil produces a non-linear term which is pure distortion. The larger the current through the coil, the larger the non-linear term becomes as this term has the current raised to the second power. For this reason, the common prior art electrodynamic sound transducer creates more distortion at higher sound levels.

In the common electrodynamic transducer, the voice coil acts as a strong inductance, and except for high frequencies where capacitive effects take place, the transducer will basically respond to the laws of an inductive-resistive circuit. Thus, the impedance can be expressed as:

$$Z = \sqrt{R^2 + X^2} \quad \text{(Eq. 5)}$$

where X is the reactance of the voice coil.

The impedance, grows with frequency, and there is a creation of a phase angle given by:

$$\phi = \mathrm{Tan}^{-1}(X/R) \quad \text{(Eq. 6)}$$

Therefore, due to its inductive qualities, the electrodynamic sound transducer has a non-linear phase response (Eq. 6), which presents a complex impedance problem (Eq. 5), and generates a self-induced distortion (Eq. 4).

The function performed by the above-described structure of the present invention to overcome the above problems will now be described. The electrically insulated highly electroconductive coated ferromagnetic shunting rings 6 which are placed on the front pole piece plate 4 and/or center pole piece 2 of the magnetic structure inhibit flux leakages in the magnetic circuit of the electrodynamic transducer and around the voice coil due to the voice coil's perturbation of the constant flux density in the magnetic structure. The use of the conductive coating on the ferromagnetic shunting rings 6 increases the conductivity of the shunting rings as electricity travels mainly on the outer surface of conductors, due to the mutual repulsive forces between electrons. If the shunting rings 6 are coated with silver which is from 5 to 10 times a better conductor than iron or steel, the effectiveness of the rings is greatly enhanced.

However, the present invention is not limited to silver coated rings but can be coated by any material which is a conductor that is better than iron or steel. Further, it is not absolutely necessary to have the ferromagnetic shunting rings coated with the highly conductive material, but if they are not coated, the performance of the device will be reduced as compared to a device having a highly conductive material coating the shunting rings. It is also possible to vary the material making up the core of the shunting rings.

A voice coil used in a common electrodynamic transducer can have a free air inductance of several millihenries. This value multiplies when the coil is inside the structure's air gap, and becomes even larger when the coil travels inside of the structure, for example, when covering a large amplitude oscillation. This occurs because when the coil is inside the structure, it will act as a choke inside a ferromagnetic core with a return structure (except for the air gap which will add reluctance). However, in a large amplitude oscillation, when the voice coil could have most of its length outside of the structure, many of the magnetic flux lines will have to travel through air and the reluctance will be much larger. Thus, an electrodynamic transducer is a variable permeability system that depends on the voice coil's position and its worst operating condition is when the voice coil is inside of the structure. The shunting rings of the present invention are most beneficial at this position because they will have to allow the greatest induced current to flow.

Therefore, the cross-sectional area of the shunting rings should be large enough to allow for sufficient induced current to flow in order to oppose the magnetic field created by the voice coil. As a voice coil produces many magnetic flux lines which depend on the current through the coil, if the shunting rings are too thick (i.e., have a large cross-sectional area) they will not be able to control the magnetic lines near the voice coil. However, if the shunting rings are relatively thin, they will control the magnetic flux lines near the voice coil but will saturate rapidly and the transducer will not properly operate at high power levels. Further, the distortion will become even greater as the resistivity of the shunting rings increases with temperature and permit even less current to flow. The solution to this problem is to use multiple shunting rings in order to allow for higher power levels. Two shunting rings on each side of the voice coil connected to the center pole piece shank and pole piece plate work sufficiently, although more than two shunting rings or only one shunting ring can be employed.

Obviously, numerous modifications and variations of the present invention are possible in light of the above teachings. For example, the use of shunting rings is not limited to the electrodynamic transducer structure illustrated in the drawings but can be employed in different types of electrodynamic transducers. It is therefore to be understood that, within the scope of the appended claims, the invention may be practiced otherwise than as specifically described herein.

What is claimed as new and desired to be secured by Letters Patent of the United States is:

1. An electrodynamic transducer, comprising:
a center pole;
a voice coil surrounding said center pole;
a magnet surrounding said voice coil;
a front pole piece plate connected to the magnet for defining an air gap between the center pole and the front pole piece plate with the voice coil disposed therein; and
at least one ferromagnetic ring, coated with a material having a higher conductivity than iron, and having two sides, one of said two sides nonconductively attached to at least one of the center pole and the front pole piece plate, and the other of said two sides facing the voice coil.

2. An electrodynamic transducer according to claim 1, wherein said at least one ferromagnetic ring comprises two rings, the rings attached to each other by nonconductive adhesive.

3. An electrodynamic transducer according to claim 1, wherein said at least one ferromagnetic ring comprises two rings, one of said two rings attached to the center pole and the other of said two rings attached to the front pole piece plate.

4. An electrodynamic transducer according to claim 1, wherein said at least one ferromagnetic ring comprises four rings, a first of said rings attached to the front pole piece plate and a second of said rings attached to the first ring, a third of said rings attached to the center pole and a fourth of said rings attached to the third ring.

5. An electrodynamic transducer according to claim 4, wherein all attachments of the rings are by nonconductive adhesive.

6. An electrodynamic transducer, comprising:
a center pole;
a voice coil surrounding said center pole;
a magnet surrounding said voice coil;
a front pole piece plate connected to the magnet for defining an air gap between the center pole and the front pole piece plate with the voice coil disposed therein; and
at least two annular, concentric ferromagnetic rings attached to each other to form at least one series of rings, said at least one series of nonconductively rings attached to at least one of the center pole and the front pole piece.

7. An electrodynamic transducer according to claim 6, wherein said at least two rings are connected to each other by nonconductive adhesive.

8. An electrodynamic transducer, comprising:
a magnetic circuit having an air gap defined therein; and
at least one ring means, electrically insulatively connected to the magnetic circuit and facing the air gap, for increasing the magnetic current carrying capacity of the magnetic circuit wherein the at lest one ring means comprises a ferromagnetic core coated with a material having a higher conductivity than iron.

9. An electrodynamic transducer according to claim 8, wherein the magnetic circuit has front pole piece plate attached to a magnet and the at least one ring means is electrically insulatively connected to the front pole piece plate.

10. An electrodynamic transducer according to claim 8, wherein the magnetic circuit has a center pole piece and the at least one ring means is electrically insulatively connected to the center pole piece.

11. An electrodynamic transducer according to claim 8, wherein the magnetic circuit has a center pole piece, and a front pole piece plate, the center pole piece and front pole piece plate each having at least one ring means electrically insulatively attached thereto, said at least one ring means electrically insulatively attached to the center pole piece and said at least one ring means electrically insulatively attached to the front pole piece plate defining said air gap of said magnetic circuit.

12. An electrodynamic transducer according to claim 11, wherein said at least one ring means electrically insulatively connected to said center pole comprises two rings attached to each other and said at least one ring means connected to the front pole piece plate comprises two rings attached to each other.

13. An electrodynamic transducer according to claim 12, wherein the attachments of the rings to each other are by nonconductive adhesive and the connection of the rings means to the front pole piece plate and the center pole piece are by nonconductive adhesive.

14. An electrodynamic transducer, comprising:
a center pole piece;
a voice coil surrounding said center pole;
a magnet surrounding said voice coil;
a front pole piece plate connected to the magnet for defining an air gap between the center pole and the front pole piece plate with the voice coil disposed therein; and
a ferromagnetic shunting device, having two sides, one of said sides adhered to one of the center pole piece and the front pole piece plate, and the other of said two sides facing the voice coil.

15. An electrodynamic transducer according to claim 14, wherein said ferromagnetic shunting device comprises one or more shunting rings, and said ferromagnetic shunting device is attached to the center pole; and
wherein said electromagnetic transducer further includes a second ferromagnetic shunting device attached to the front pole piece plate.

16. An electrodynamic transducer according to claim 14, wherein said ferromagnetic shunting device comprises one or more shunting rings, each coated with a material having a higher conductivity than iron, the shunting rings are adhered to each other by nonconductive adhesive, the ferromagnetic shunting device is adhered with nonconductive adhesive to one of the center pole piece and to the front pole piece plate.

17. An electromagnetic transducer according to claim 15, wherein said first and second ferromagnetic shunting devices each comprise one or more shunting rings, each coated with a material having a higher conductivity than iron, the shunting rings are adhered to each other by nonconductive adhesive, the first ferromagnetic shunting device adhered to the center pole piece by nonconductive adhesive, and the second ferromagnetic shunting device adhered to the front pole piece plate by nonconductive adhesive.

* * * * *